US006213783B1

(12) United States Patent
Kankkunen

(10) Patent No.: US 6,213,783 B1
(45) Date of Patent: Apr. 10, 2001

(54) ARRANGEMENT IN CONNECTION WITH ANAESTHETIC DEVICES

(75) Inventor: Jukka Kankkunen, Helsinki (FI)

(73) Assignee: Instrumentarium Corporation, Helsinki (FI)

( * ) Notice: Subject to any disclaimer, the term of this patent is extended or adjusted under 35 U.S.C. 154(b) by 0 days.

(21) Appl. No.: 09/033,813

(22) Filed: Mar. 3, 1998

(30) Foreign Application Priority Data

Mar. 4, 1997 (FI) ..... 970925

(51) Int. Cl.[7] ..... H01R 11/30
(52) U.S. Cl. ..... 439/39
(58) Field of Search ..... 439/38–40

(56) References Cited

U.S. PATENT DOCUMENTS 3,521,216 * 7/1970 Tolegian ..... 439/39
4,451,113 5/1984 Zuniga ..... 439/38
5,779,487 * 7/1998 Gatin ..... 439/39
5,829,987 * 11/1998 Fritsch et al. ..... 439/38

FOREIGN PATENT DOCUMENTS

97/05673 2/1997 (WO) .

* cited by examiner

*Primary Examiner*—Hien Vu
(74) *Attorney, Agent, or Firm*—Andrus Sceales Starke & Sawall, LLP

(57) ABSTRACT

An arrangement in connection with anaesthetic devices which comprise at least two module units, which are integrated to function together, and data transmission between the module units is carried out by means of a connector arrangement, which comprises contact means arranged in both module units. To provide a durable connector arrangement at least one of the connector means is mobile so that when the module units and thereby the contact means are moved close to one another, the mobile contact means moves so that it comes into contact with the contact means in the other module unit as a result of magnetising force.

9 Claims, 3 Drawing Sheets

ARRANGEMENT IN CONNECTION WITH ANAESTHETIC DEVICES

BACKGROUND OF THE INVENTION

The invention relates to an arrangement in connection with anaesthetic devices which comprise at least two module units, which are integrated to function together, and data transmission between the module units is carried out by means of a connector arrangement, which comprises contact means arranged in both module units.

Such arrangements are nowadays rather well known in the field of technology related to anaesthetic devices. Anaesthetic devices, such as different monitors used in the control rooms of hospitals for measuring and controlling vital functions and anaesthetic units with monitors and respiration apparatuses used mainly in the surgical wards of hospitals, usually comprise different module units which are integrated to function together in one way or another. Data transmission, e.g. electronic data transmission, between different module units has been implemented on a case by case basis taking into account the user's requirements. The most commonly used solution is a fixed module unit, in which solution the module unit is not meant to be disconnected and the connection is provided by a fixed cable. The drawback associated with this solution is that it is difficult to disconnect the module units from each other, and thus the solution can be applied only to certain devices.

If the user needs a mobile module. the typical known solution available is an arrangement consisting of a cable and a box. The drawback associated with this solution is that the arrangement comprises visible cables, which can be in the way, and thus hamper the use of the device in some situations. In the case of the solution comprising a cable and a box, changing and storing of the module units which have to be changed often may sometimes be difficult because of the cable.

To eliminate the disadvantages described above a solution in which a connector and a counter-connector are used between module units without an intermediate cable has been developed in the field. Such an arrangement implemented e.g. with generally known D connector pairs is quicker and more user-friendly than the arrangements described above, since there is no cable hampering the use. A disadvantage associated with solutions of this kind is that the connector has to be guided to the counter-connector very accurately, whereby rather accurate guiding members are needed between the module units, which easily results in rather expensive solutions. Another disadvantage is that the installation of the connector in the module unit is restricted so that the direction of the connectors has to be the same as the installation direction of the module units, whereby restriction of the motion of the module unit with respect to the installation direction requires precision, and possibly separate springs are needed in the connectors, which also increases costs. A further disadvantage is that uncovered, visible connectors dirty easily, which reduces conductivity of the connection. If the connection described above is not implemented as a floating arrangement for example by using springs, the vibration caused during transportation, for instance, may very easily damage the connector.

Further connection arrangements are also known in the field, such as infrared solutions, optical solutions, etc. External interferences, expensive arrangements which take up too much space, etc. constitute disadvantages of these solutions.

BRIEF SUMMARY OF THE INVENTION

An object of the invention is to provide an arrangement which allows to eliminate the disadvantages of the prior art.

This is achieved with the arrangement of the invention, which is characterized in that at least one of the contact means is mobile so that when the module units and thereby the contact means are moved close to one another, the mobile contact means moves so that it comes into contact with the contact means in the other module unit as a result of magnetic force.

An advantage of the invention is, for example, that the connection between the module units is similar to the connection between bayonet joints, whereby the module units can be connected with each other electrically and disconnected from each other over and over again without the contact means of the connector arrangement wearing to a harmful extent. The arrangement of the invention can also be installed in the module unit without restrictions. Furthermore, the arrangement of the invention is hidden, which allows to avoid misuse, and it can be cleaned without interfering with its operation. Another advantage of the invention is that the connector does not require as accurate guiding as those of the prior art. The arrangement of the invention also sustains the vibration caused during transportation as well. The arrangement of the invention can be applied in a large variety of devices between different module units. The power transmission capacity of the arrangement of the invention can be adjusted on a case by case basis in a simple manner. In addition, the arrangement of the invention is cheap and can be implemented in a simple manner, while the operational reliability of the arrangement is good.

BRIEF DESCRIPTION OF THE SEVERAL VIEWS OF THE DRAWING

In the following, the invention will be described in greater detail by means of a preferred embodiment illustrated in the accompanying drawings, in which.

DETAILED DESCRIPTION OF THE INVENTION

Figure 1:
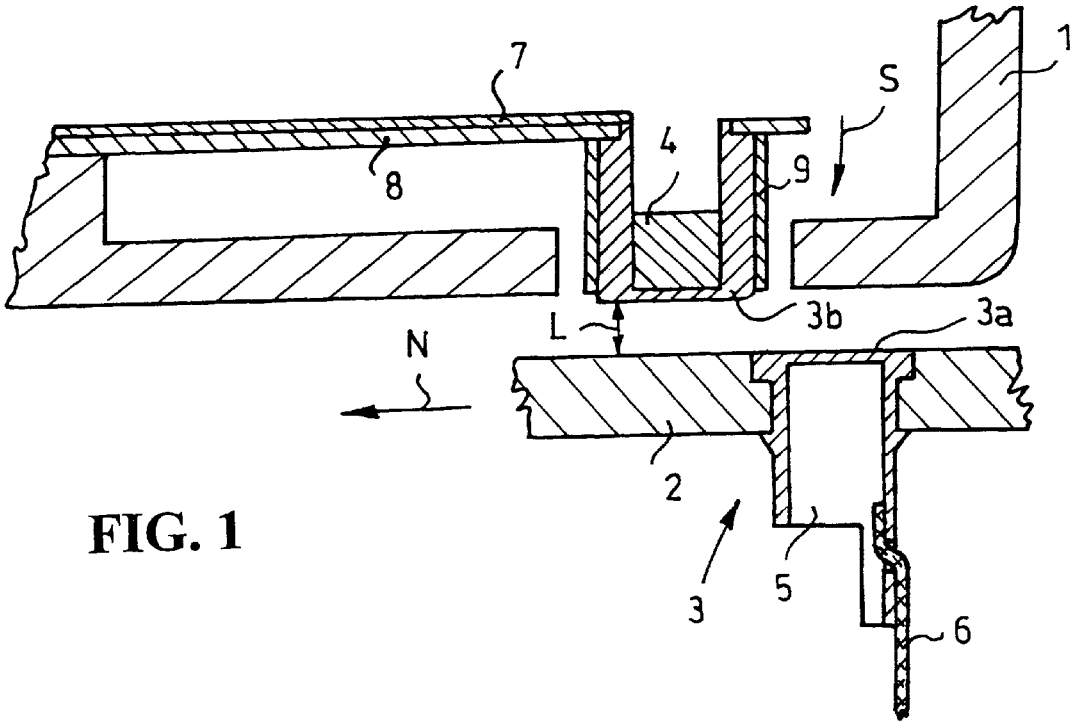
FIG. 1 is a schematic side view of the arrangement of the invention when two module units are being connected with each other.
Figure 2:
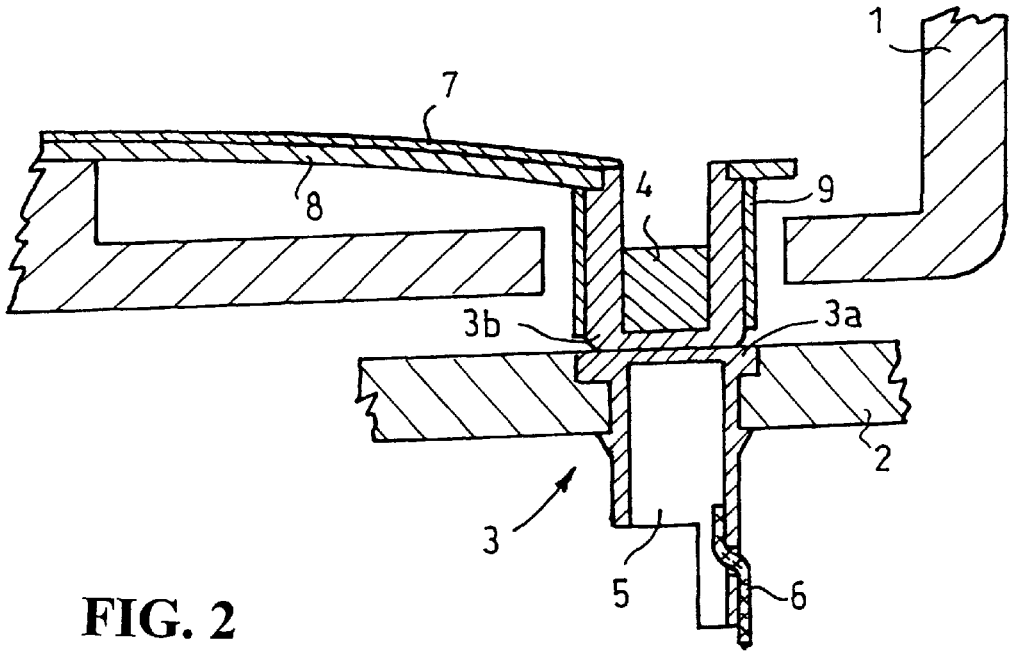
FIG. 2 shows the connection of FIG. 1 in a situation in which the contact means are in contact with each other.

FIGS. 1 and 2 schematically illustrate a preferred embodiment of the arrangement of the invention. Reference numbers 1 and 2 denote two module units of which module unit 1 is the vaporiser casing of an anaesthetic unit and module unit 2 is an anaesthetic vaporiser cassette. The module units 1 and 2 are shown only partially in FIGS. 1 and 2, since the structure and operation of the units in question is conventional technology to one skilled in the art, which will not be described more closely in this context. The module units are integrated to function together, and data transmission between the module units is carried out by means of a separate connector arrangement 3.

The connector arrangement 3 according to the arrangement shown in the figures comprises fixed contact means 3*a* arranged in one module unit 2 and mobile contact means 3*b* arranged in the other module unit 1. When the module units 1 and 2, and thereby the contact means 3*a*, 3*b* are moved close to one another, the mobile contact means 3*b* moves so that it comes into contact with the immobile contact means 3*a* as a result of magnetic force. In practice, the module units 1, 2 are usually moved close to each other in such a manner that one module unit 1, the vaporiser casing of the anaesthetic unit in the example of the figures, is stationary, and the other module unit 2, the anaesthetic vaporiser cassette, is moved so that it comes into contact with the module unit 1.

Figure 4:
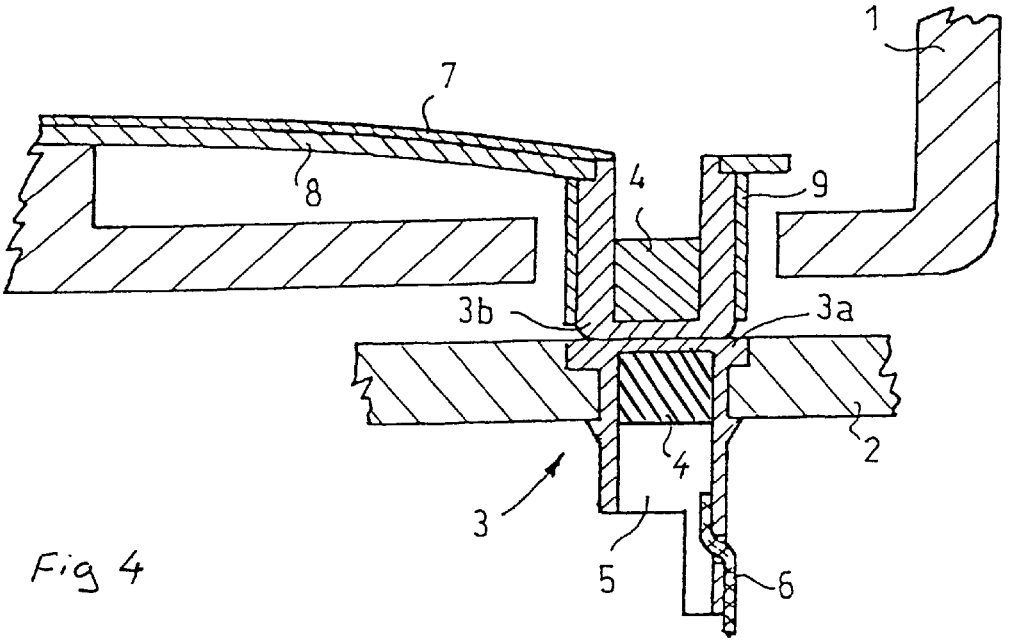
FIG. 4 is an alternate embodiment of the invention in which each contact means includes a magnetic member to aid in holding the contact means in contact with each other.

Arrow N in FIG. 1 illustrates the direction of movement of the module unit 2 in relation to the module unit 1 when they are connected to each other. The basic idea is that when the module unit 1 moves in the direction of arrow N so that the contact means 3*a*, 3*b* come close enough to each other, magnetic force pulls the mobile contact means 3*b* into contact with the immobile contact means 3*a*. This situation is illustrated in FIG. 2. The magnetic force can be generated by the use of with a magnet member 4 arranged in the mobile contact means 3*b* and magnetic material, such as a magnetic metal, arranged in the immobile contact means 3*a*. If the reaction distance L of the connector arrangement is to be increased, a magnet member can also be arranged in the immobile contact means 3*a*, such as in the space 5, as shown in FIG. 4.

Figure 3:
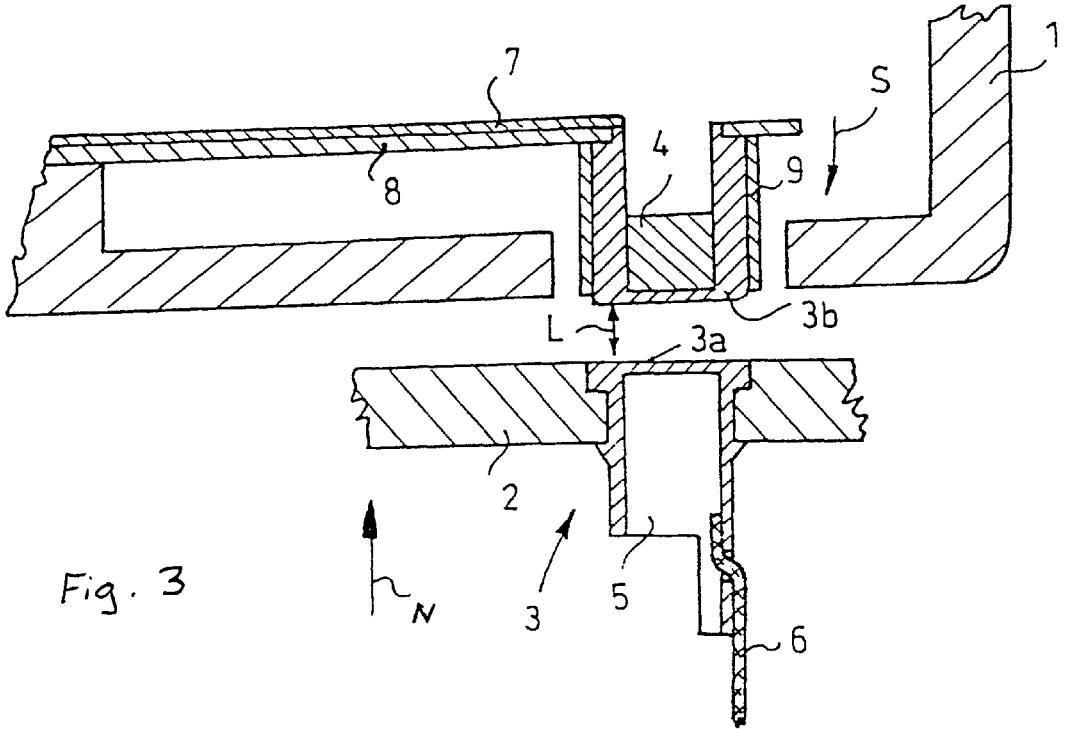
FIG. 3 is a schematic side view similar to FIG. 1 illustrating an alternate direction of movement between the two module units that are being connected with each other.

In the example of the figures, the direction of motion S of the mobile contact means is transverse to the direction of motion N of the module unit 2. An advantage of the solution is, for example, that when the contact is created, between the contact means 3*a* and 3*b* the contact surfaces rub against each other for a moment, since the module unit 2 moves in direction N. This keeps the contact surfaces clean. Naturally, the invention can also be implemented so that the direction of motion of the moving contact means is parallel with the direction of motion N of the module unit 2, as illustrated in FIG. 3.

In the example of the figures the contact means 3*b* are supported by means of a flexible member 8, which gives away while magnetic force pulls the mobile contact means 3*b* out of the module unit 1 and into the position shown in FIG. 2. When the module unit 2 is pulled away, from the module unit 1 i.e. moved in a direction transverse to direction N, the contact surfaces rub against each other until they are disconnected, and the flexible means 8 pull the mobile contact means 3*b* back to the biased position within the module unit 1, as shown in FIG. 1. Any appropriate means, e.g. a thin circuit card, can function as the flexible means 8.

Information, e.g. electronic information, can be transmitted to and from the fixed contact means 3*a* by means of a cable 6, for example. Correspondingly, electronic information can be transmitted to or from the mobile contact means by means of a cable 7, for example. The contact surfaces are naturally made of a material that conducts electricity. If necessary, the contact means 3*b* can be provided with a protection 9 against contact, which prevents a short circuit.

Figure 5:
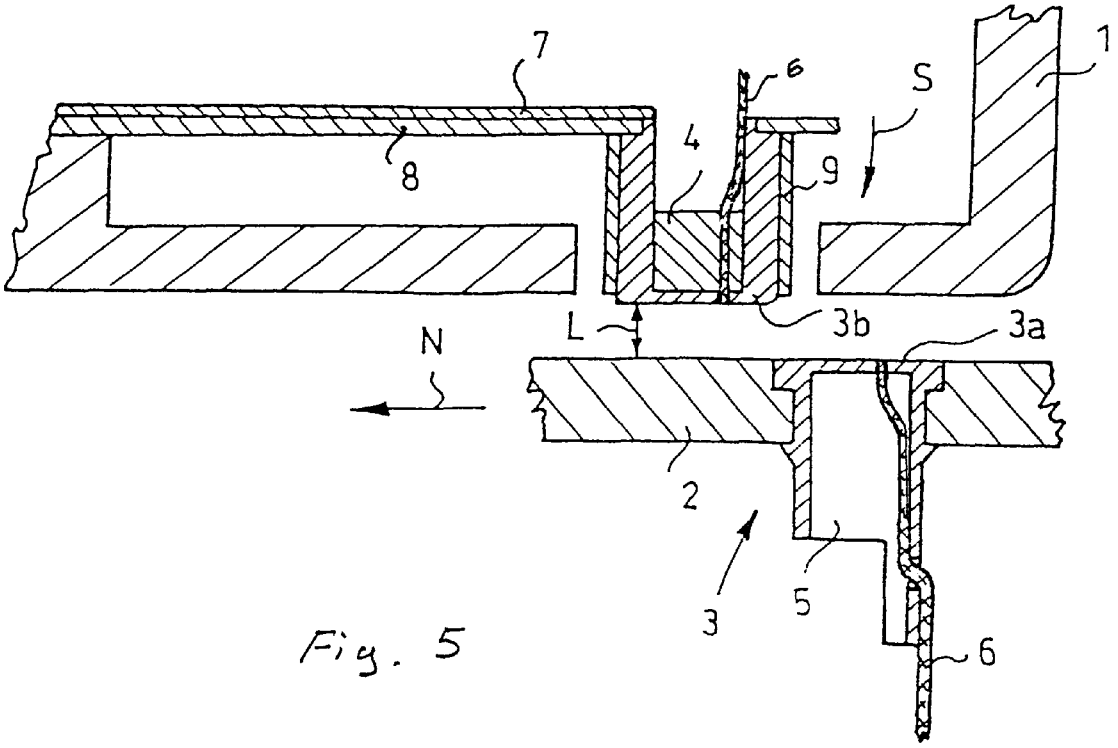
FIG. 5 is an additional alternate embodiment in which the contact means include a connection for optical data transmission.

The embodiment described above is not intended to restrict the invention in any way, but the invention may be modified quite freely within the scope of the claims. It is thus clear that the arrangement of the invention or its details need not be identical to the those shown in the figures, but other solutions are also possible. In the example of the figures, the fixed contact means is arranged in the mobile module unit and the mobile contact means is arranged in the stationary module unit. This is, however, not the only alternative. The fixed contact means may also be arranged in the stationary module unit and the mobile contact means in the mobile module unit. It is also obvious that both module units can be units which are mobile in relation to each other, etc. Within the scope of the invention it is also possible to arrange both contact means so that they are mobile. In such applications the contact means can be arranged so that they do not move or are not released until the mobile module unit has moved into a certain position with respect to the immobile module unit. The contact means can be arranged to lock and to be released for example with mechanical means, which are guided on the basis of the position of the mobile module unit. Even though the invention has been described above in connection with an embodiment utilizing electronic data transmission, the invention is not, in any way limited to that application. The invention can also be applied in connection with optical data transmission, as best illustrated in FIG. 5 for example.

What is claimed is:

1. An electrical connector arrangement for use in connection with anaesthetic devices having at least a first module unit and a second module unit integrated to function together, wherein data transmission between the first module unit and the second module unit is carried out by the connector arrangement, the connector arrangement comprising:

a first contact arranged in the first module unit, the first contact being mounted on a flexible member for movement into and out of the first module unit, the flexible member being biased to normally position the first contact within the first module unit;

a second contact arranged in the second module unit; and wherein one of the first contact and the second contact includes a magnetic member such that when the first module unit and the second module unit are moved close together, the magnetic force of the magnetic member moves the first contact out of the first module unit against the bias of the flexible member and into contact with the second contact, wherein the movement of the first contact out of the first module unit is transverse to a movement of the first module unit relative to the second module unit.

2. The connector arrangement of claim 1 wherein the second contact is fixed in the second module unit.

3. The connector arrangement of claim 1 wherein the movement of the first contact into contact with the second contact is provided by the magnetizing force of the magnetic member arranged in one of the first and second contacts and a magnetic material arranged in the other of the first and second contacts.

4. The connector arrangement of claim 1 wherein both the first contact and the second contact include a magnetic member.

5. The connector arrangement of claim 1 wherein the first contact and the second contact are formed to transmit information electronically.

6. The connector arrangement of claim 1 wherein the first contact and the second contact are formed to transmit information optically.

7. An electrical connector arrangement connecting anaesthetic devices having a vaporizer casing of an anaesthetic unit and an anaesthetic vaporizer cassette integrated to function together, wherein data transmission between the vaporizer casing and the anaesthetic vaporizer cassette is carried out by the connector arrangement, the connector arrangement comprising:

a first contact arranged in the vaporizer casing, the first contact being mounted on a flexible member for movement into and out of the vaporizer casing, the flexible member being biased to normally position the first contact within the vaporizer casing;

a second contact arranged in the anaesthetic vaporizer cassette; and wherein one of the first contact and the second contact includes a magnetic member such that when the vaporizer casing and the anaesthetic vaporizer cassette are moved close together, the magnetic force of the magnetic member moves the first contact out of the vaporizer casing against the bias of the flexible member and into contact with the second contact.

8. The connector arrangement of claim 7 wherein the direction of motion of the first contact is parallel to the direction of motion of the first module unit relative to the second module unit.

9. An electrical connector arrangement connecting aesthetic devices having an anaesthetic vaporizer cassette and a vaporizer casing of an anaesthetic unit integrated to function together, wherein data transmission between the anaesthetic vaporizer cassette and the vaporizer casing is carried out by the connector arrangement, the connector arrangment comprising:

a first contact arranged in the anaesthetic vaporizer cassette, the first contact being mounted on a flexible member for movement into and out of the anaesthetic vaporizer cassette, the flexible member being biased to normally position the first contact within the anaesthetic vaporizer cassette a second contact arranged in the vaporizer casing; and wherein one of the first contact and the second contact includes a magnetic member such that when the anaesthetic vaporizer cassette and the vaporizer casing are moved close together, the magnetic force of the magnetic member moves the first contact out of the anaesthetic vaporizer cassette against the bias of the flexible member and into contact with the second contact.

* * * * *